US008074572B1

(12) United States Patent
Bland et al.

(10) Patent No.: US 8,074,572 B1
(45) Date of Patent: Dec. 13, 2011

(54) CONICAL DART SUB-MUNITIONS FOR CARGO ROUND

(75) Inventors: Geoffrey A. Bland, King George, VA (US); Larry Stephen Weedon, II, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 464 days.

(21) Appl. No.: 12/386,177

(22) Filed: Mar. 30, 2009

(51) Int. Cl.
*F42B 12/58* (2006.01)

(52) U.S. Cl. ..... 102/489; 102/438; 102/703

(58) Field of Classification Search ..... 102/436, 102/438, 439, 473, 489, 501, 703
See application file for complete search history.

(56) References Cited

U.S. PATENT DOCUMENTS

| | | | | | |
|---|---|---|---|---|---|
| 911,793 | A * | 2/1909 | Wille | 102/490 |
| 3,877,381 | A * | 4/1975 | McCoy | 102/501 |
| 3,938,442 | A * | 2/1976 | Donadio | 102/494 |
| 4,036,140 | A * | 7/1977 | Korr et al. | 102/438 |
| 4,036,141 | A * | 7/1977 | Korr et al. | 102/438 |
| 4,444,117 | A | 4/1984 | Mitchell, Jr. | 102/489 |
| 4,953,466 | A | 9/1990 | von Gerlach | 102/521 |
| 4,996,923 | A * | 3/1991 | Theising | 102/438 |
| 5,796,031 | A * | 8/1998 | Sigler | 102/520 |
| 6,094,054 | A | 7/2000 | Crist | 324/452 |
| 7,004,073 | B2 * | 2/2006 | Michel | 102/393 |
| 7,823,509 | B2 * | 11/2010 | Dindl et al. | 102/438 |
| 2008/0307994 | A1 * | 12/2008 | Gustafsson et al. | 102/489 |

OTHER PUBLICATIONS

The Gyroscopic Stability Condition: http://www.nennstiel-ruprechi.de/bullfly/gyrocond.htm.
The Dynamic stability Condition:http://www.nennstiel-ruprechi.de/bullfly/dynacond.htm.
The Tractability Condition: http://www.nennstiel-ruprecht.de/bullfly/unctf.htm.

* cited by examiner

*Primary Examiner* — Gabriel Klein
(74) *Attorney, Agent, or Firm* — Gerhard W. Thielman, Esq

(57) ABSTRACT

A cargo round (e.g., 155 mm high explosive projectile) is provided for dispensing submunitions. The round includes a nose tip, a casing attached thereto forming a chamber, a tail and a payload in the chamber between the tip and tail. The payload includes a plurality of axi-symmetric darts mounted on a plurality of front and rear tandem plates. Each dart has fore and aft ends along a polar axis. Each dart is shaped as a cone at its fore end and includes a cavity at its aft end. Each plate has a plurality of orifices arranged in a regular pattern. Each orifice receives a corresponding dart to protrude from both obverse and reverse sides of the plate. Each fore end of its dart in the rear plate inserts into the cavity of a counterpart dart in the front plate, and each plate shears apart on release of the payload to disperse the darts. The plates preferably have a plurality of notches arranged in rows on the reverse side, together with a lip at an outer rim and bounded recess region within the lip on the obverse side, with the orifices are disposed in the region.

10 Claims, 16 Drawing Sheets

SECTION A-A

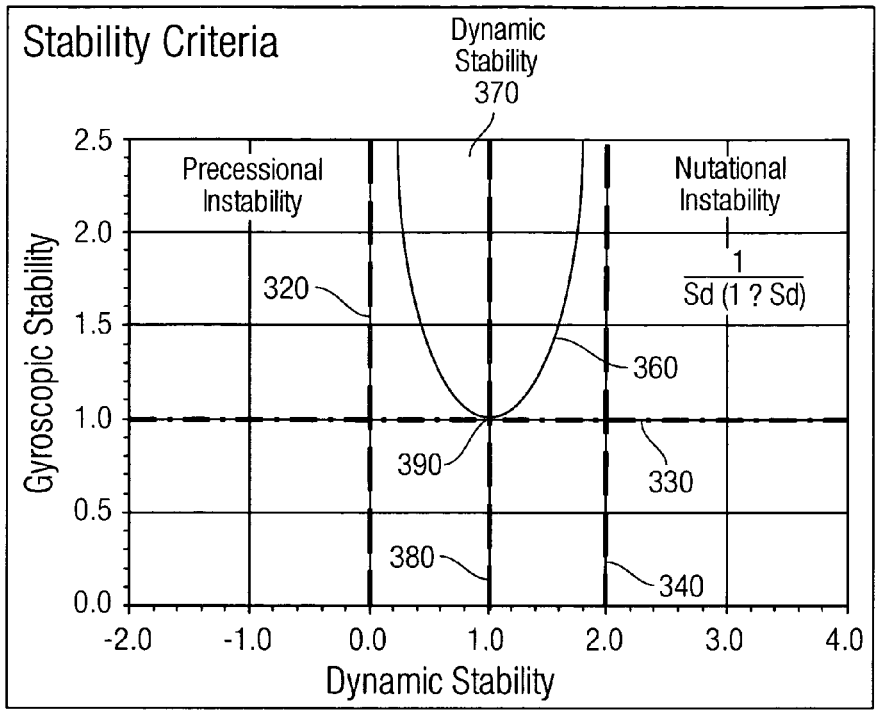
Fig. 3
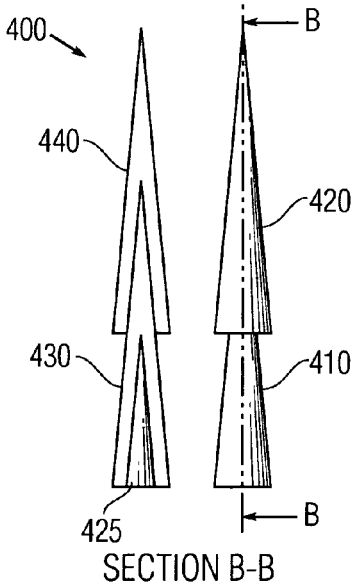
Fig. 4
Table 1 User input data 500
| | |
|---|---|
| Dart Diameter | 0.870 cm |
| Weight | 20.144 gm |
| Axial Inertia | different for each dart gm-cm^2 |
| Trans Inertia | different for each dart gm-cm^2 |
| Muzzle Velocity | 792.5 m/sec |
| Spin Rate | 260 HZ |
| Launch Altitude above Sea Level | Launch Altitude above 0.0 m |
| Temperature | 15.0 C [STP] |
| Pressure | 1013.2 millibars [STP] |
| Density | 1.2250 kg/m^3 |
| Speed of Sound | 340.3 m/sec |
Fig. 5

900

Table 2 Cone Stability Table

| Mach | sg | Static Stability | sd | 1/sd ·(2–sd) | Dynamic Stability |
|---|---|---|---|---|---|
| 1.000 | 2.85 | yes | 1.96 | 12.7551 | Neutral |
| 1.025 | 3.03 | yes | 2.01 | –49.7512 | Neutral |
| 1.050 | 3.24 | yes | 2.03 | –16.4204 | Neutral |
| 1.100 | 3.12 | yes | 1.76 | 2.367424 | Stable |
| 1.200 | 3.06 | yes | 1.42 | 1.214182 | Stable |
| 1.350 | 2.87 | yes | 1.19 | 1.037452 | Stable |
| 1.500 | 2.25 | yes | 0.94 | 1.003613 | Stable |
| 1.750 | 1.90 | yes | 0.96 | 1.001603 | Stable |
| 2.000 | 1.92 | yes | 0.97 | 1.000901 | Stable |
| 2.250 | 1.86 | yes | 0.98 | 1.00040 | Stable |
| 2.500 | 1.80 | yes | 0.99 | 1.00010 | Stable |

Fig. 9

1100

Table 3 Boattail stability

| Boattail | | | | | 1110 |
|---|---|---|---|---|---|
| Mach | sg | Static Stability | sd | 1/sd(2-sd) | Dynamic Stability |
| 1,.000 | 3.20 | yes | 1.36 | 1.148897 | Stable |
| 1.025 | 3.40 | yes | 1.43 | 1.226843 | Stable |
| 1.050 | 3.64 | yes | 1.49 | 1.315963 | Stable |
| 1.100 | 3.57 | yes | 1.32 | 1.114082 | Stable |
| 1.200 | 3.53 | yes | 1.11 | 1.012248 | Stable |
| 1.350 | 3.39 | yes | 0.94 | 1.003613 | Stable |
| 1.500 | 2.98 | yes | 0.76 | 1.061121 | Stable |
| 1.750 | 2.71 | yes | 0.78 | 1.050862 | Stable |
| 2.000 | 2.74 | yes | 0.79 | 1.046135 | Stable |
| 2.250 | 2.68 | yes | 0.80 | 1.041667 | Stable |
| 2.500 | 2.63 | yes | 0.81 | 1.037452 | Stable |
| boatail.5 | | | | | 1120 |
| Mach | sg | Static Stability | sd | 1/sd ·(2–sd) | Dynamic Stability |
| 1.000 | 3.16 | yes | 1.32 | 1.114082 | Stable |
| 1.025 | 3.32 | yes | 1.40 | 1.190476 | Stable |
| 1.050 | 3.48 | yes | 1.46 | 1.268392 | Stable |
| 1.100 | 3.42 | yes | 1.30 | 1.098901 | Stable |
| 1.200 | 3.39 | yes | 1.10 | 1.010101 | Stable |
| 1.350 | 3.25 | yes | 0.94 | 1.003613 | Stable |
| 1.500 | 2.89 | yes | 0.76 | 1.061121 | Stable |
| 1.750 | 2.65 | yes | 0.78 | 1.050862 | Stable |
| 2.000 | 2.66 | yes | 0.79 | 1.046135 | Stable |
| 2.250 | 2.61 | yes | 0.80 | 1.041667 | Stable |
| 2.500 | 2.56 | yes | 0.81 | 1.037452 | Stable |

Fig. 11

1200

Table 5 Witch's Hat Cone

| Witch's Hat Small | | | | | 1210 |
|---|---|---|---|---|---|
| Mach | sg | Static Stability | sd | 1/sd ·(2–sd) | Dynamic Stability |
| 1.000 | 0.59 | no | N/A | N/A | N/A |
| 1.025 | 0.65 | no | N/A | N/A | N/A |
| 1.050 | 0.71 | no | N/A | N/A | N/A |
| 1.100 | 0.70 | no | N/A | N/A | N/A |
| 1.200 | 0.69 | no | N/A | N/A | N/A |
| 1.350 | 0.64 | no | N/A | N/A | N/A |
| 1.500 | 0.53 | no | N/A | N/A | N/A |
| 1.750 | 0.46 | no | N/A | N/A | N/A |
| 2.000 | 0.46 | no | N/A | N/A | N/A |
| 2.250 | 0.44 | no | N/A | N/A | N/A |
| 2.50 | 0.43 | no | N/A | N/A | N/A |
| | | | | | |
| Witch's Hat Large | | | | | 1220 |
| Mach | sg | Static Stability | sd | 1/sd ·(2–sd) | Dynamic Stability |
| 1.000 | 0.93 | no | N/A | N/A | N/A |
| 1.025 | 1.01 | yes | 2.35 | –1.21581 | Neutral |
| 1.050 | 1.11 | yes | 2.49 | –0.81960 | Neutral |
| 1.100 | 1.09 | yes | 2.07 | –6.90131 | Neutral |
| 1.200 | 1.07 | yes | 1.61 | 1.592610 | Neutral |
| 1.350 | 1.01 | yes | 1.16 | 1.026273 | Neutral |
| 1.500 | 0.86 | no | N/A | N/A | N/A |
| 1.750 | 0.76 | no | N/A | N/A | N/A |
| 2.000 | 0.75 | no | N/A | N/A | N/A |
| 2.250 | 0.74 | no | N/A | N/A | N/A |
| 2.50 | 0.72 | no | N/A | N/A | N/A |

Fig. 12

1500 Table 6 Cylinder Cone

| Steel Cylinder Cone | | | | | 1510 |
|---|---|---|---|---|---|
| Mach | sg | Static Stability | sd | 1/sd ·(2–sd) | Dynamic Stability |
| 1.000 | 1.41 | yes | 1.43 | 1.226843 | Stable |
| 1.025 | 1.54 | yes | 1.49 | 1.315963 | Stable |
| 1.050 | 1.70 | yes | 1.53 | 1.390627 | Stable |
| 1.100 | 1.65 | yes | 1.34 | 1.130710 | Stable |
| 1.200 | 1.62 | yes | 1.11 | 1.012248 | Stable |
| 1.350 | 1.54 | yes | 0.94 | 1.003613 | Stable |
| 1.500 | 1.31 | yes | 0.75 | 1.066667 | Stable |
| 1.750 | 1.16 | yes | 0.77 | 1.055855 | Stable |
| 2.000 | 1.17 | yes | 0.79 | 1.046135 | Stable |
| 2.250 | 1.15 | yes | 0.79 | 1.046135 | Stable |
| 2.50 | 1.12 | yes | 0.8 | 1.041667 | Stable |
| | | | | | |
| 0.2 in Cylinder | | | | | 1520 |
| Mach | sg | Static Stability | sd | 1/sd(2-sd) | Dynamic Stability |
| 1 | 3.48 | yes | 1.43 | 1.226843 | Stable |
| 1.025 | 3.81 | yes | 1.49 | 1.315963 | Stable |
| 1.05 | 4.21 | yes | 1.53 | 1.390627 | Stable |
| 1.1 | 4.08 | yes | 1.34 | 1.13071 | Stable |
| 1.2 | 4 | yes | 1.11 | 1.012248 | Stable |
| 1.35 | 3.82 | yes | 0.94 | 1.003613 | Stable |
| 1.5 | 3.23 | yes | 0.75 | 1.066667 | Stable |
| 1.75 | 2.88 | yes | 0.77 | 1.055855 | Stable |
| 2 | 2.9 | yes | 0.79 | 1.046135 | Stable |
| 2.25 | 2.84 | yes | 0.79 | 1.046135 | Stable |
| 2.5 | 2.77 | yes | 0.8 | 1.041667 | Stable |
| | | | | | |
| 0.2in Reactive Cylinder Cone | | | | | 1530 |
| | | | | | |
| Mach | sg | Static Stability | sd | 1/sd(2-sd) | Dynamic Stability |
| 1.000 | 3.56 | yes | 1.43 | 1.226843 | Stable |
| 1.025 | 4.08 | yes | 1.45 | 1.253918 | Stable |
| 1.050 | 4.78 | yes | 1.46 | 1.268392 | Stable |
| 1.100 | 4.56 | yes | 1.31 | 1.106317 | Stable |
| 1.200 | 4.45 | yes | 1.10 | 1.010101 | Stable |
| 1.350 | 4.19 | yes | 0.99 | 1.000100 | Stable |
| 1.500 | 3.30 | yes | 0.84 | 1.026273 | Stable |
| 1.750 | 2.84 | yes | 0.86 | 1.019992 | Stable |
| 2.000 | 2.90 | yes | 0.87 | 1.017191 | Stable |
| 2.250 | 2.82 | yes | 0.88 | 1.014610 | Stable |
| 2.500 | 2.74 | yes | 0.88 | 1.014610 | Stable |

Fig. 15A

1500 Table 7 Cylinder Cone

| Reactive 75% of 0.2 in Cylinder | | | | | 1540 |
|---|---|---|---|---|---|
| Mach | sg | Static Stability | sd | 1/sd ·(2–sd) | Dynamic Stability |
| 1.000 | 2.86 | yes | 1.38 | 1.168770 | Stable |
| 1.025 | 3.18 | yes | 1.42 | 1.214182 | Stable |
| 1.050 | 3.59 | yes | 1.44 | 1.240079 | Stable |
| 1.100 | 3.46 | yes | 1.28 | 1.085069 | Stable |
| 1.200 | 3.39 | yes | 1.06 | 1.003613 | Stable |
| 1.350 | 3.22 | yes | 0.92 | 1.006441 | Stable |
| 1.500 | 2.65 | yes | 0.75 | 1.066667 | Stable |
| 1.750 | 2.33 | yes | 0.77 | 1.055855 | Stable |
| 2.000 | 2.36 | yes | 0.78 | 1.050862 | Stable |
| 2.250 | 2.3 | yes | 0.79 | 1.046135 | Stable |
| 2.500 | 2.25 | yes | 0.8 | 1.041667 | Stable |
| Reactive 25% of 0.2 in Cylinder | | | | | 1550 |
| Mach | sg | Static Stability | sd | 1/sd ·(2–sd) | Dynamic Stability |
| 1.000 | 3.56 | yes | 1.42 | 1.214182 | Stable |
| 1.025 | 4.01 | yes | 1.45 | 1.253918 | Stable |
| 1.050 | 4.60 | yes | 1.46 | 1.268392 | Stable |
| 1.100 | 4.42 | yes | 1.31 | 1.106317 | Stable |
| 1.20 | 4.32 | yes | 1.10 | 1.010101 | Stable |
| 1.350 | 4.09 | yes | 0.97 | 1.000901 | Stable |
| 1.500 | 3.30 | yes | 0.82 | 1.033485 | Stable |
| 1.750 | 2.87 | yes | 0.83 | 1.029760 | Stable |
| 2.000 | 2.93 | yes | 0.84 | 1.026273 | Stable |
| 2.250 | 2.85 | yes | 0.85 | 1.023018 | Stable |
| 2.500 | 2.77 | yes | 0.86 | 1.019992 | Stable |
| Reactive Plug Tungsten Shell | | | | | 1560 |
| Mach | sg | Static Stability | sd | 1/sd ·(2–sd) | Dynamic Stability |
| 1.025 | 2.96 | yes | 1.73 | 2.140869 | Stable |
| 1.050 | 3.59 | yes | 1.73 | 2.140869 | Stable |
| 1.100 | 3.39 | yes | 1.58 | 1.506932 | Stable |
| 1.200 | 3.31 | yes | 1.36 | 1.148897 | Stable |
| 1.350 | 3.09 | yes | 1.24 | 1.061121 | Stable |
| 1.500 | 2.33 | yes | 1.09 | 1.008166 | Stable |
| 1.750 | 1.97 | yes | 1.11 | 1.012248 | Stable |
| 2.000 | 2.03 | yes | 1.12 | 1.014610 | Stable |
| 2.250 | 1.96 | yes | 1.13 | 1.017191 | Stable |
| 2.500 | 1.90 | yes | 1.13 | 1.017191 | Stable |

Fig. 15B

1500 Table 4 Cylinder Cone

| Small Reactive Cone Tip Inside cone | | | | | 1570 |
|---|---|---|---|---|---|
| Mach | sg | Static Stability | sd | 1/sd -(2-sd) | Dynamic Stability |
| 1.000 | 3.90 | yes | 1.27 | 1.078632 | Stable |
| 1.025 | 4.26 | yes | 1.32 | 1.114082 | Stable |
| 1.050 | 4.70 | yes | 1.35 | 1.139601 | Stable |
| 1.100 | 4.56 | yes | 1.18 | 1.033485 | Stable |
| 1.200 | 4.47 | yes | 0.97 | 1.000901 | Stable |
| 1.350 | 4.27 | yes | 0.82 | 1.033485 | Stable |
| 1.500 | 3.62 | yes | 0.65 | 1.139601 | Stable |
| 1.750 | 3.23 | yes | 0.67 | 1.122209 | Stable |
| 2.000 | 3.25 | yes | 0.68 | 1.114082 | Stable |
| 2.250 | 3.18 | yes | 0.69 | 1.106317 | Stable |
| 2.50 | 3.11 | yes | 0.70 | 1.098901 | Stable |

Fig. 15C

CONICAL DART SUB-MUNITIONS FOR CARGO ROUND

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to submunition packaging in a cargo round. In particular, the invention provides a large plurality of flight-stabile darts for target release.

The 155 mm high explosive (HE) M483A1 cargo round carries a payload of dual-purpose grenades: (a) armor defeating (M42) and (b) anti-personnel (M46). Upon detonation of the primer, the flash ignites the propelling charge producing gases that eject the spin-stabilized projectile from the gun and propels the projectile to the target. The fuze, having been set to function at a pre-determined time in flight, initiates the expulsion charge ejecting the entire grenade load from the rear of the projectile. Centrifugal force from spinning disperses the grenades radially from, the projectile's line-of-flight. The M42 and M46 grenades are ground-burst submissiles that explode on impact.

SUMMARY

Conventional submunition configurations for the cargo round yield disadvantages addressed by various exemplary embodiments of the present invention. In particular, various exemplary embodiments provide a cargo round (e.g., 155 mm high explosive projectile) for dispensing submunitions. The round includes a nose tip, a casing attached thereto forming a chamber, a tail and a payload in the chamber between the tip and tail. The payload includes a plurality of axi-symmetric darts mounted on a plurality of front and rear tandem plates.

Each dart has fore and aft ends along a polar axis. Each dart is shaped as a cone at its fore end and includes a cavity at its aft end. Each plate has a plurality of orifices arranged in a regular pattern. Each orifice receives a corresponding dart to protrude from both obverse and reverse sides of the plate. Each fore end of its dart in the rear plate inserts into the cavity of a counterpart dart in the front plate, and each plate shears apart on release of the payload to disperse the darts.

In various exemplary embodiments, the plates preferably have a plurality of notches arranged in rows on the reverse side, together with a lip at an outer rim and bounded recess region within the lip on the obverse side, with the orifices are disposed in the region.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which:

FIG. 3 is a graphical view of relationship between stability factors;

FIG. 4 is an elevation view of a pair of stacked darts;

FIG. 5 is a tabular list of input parameters for dart stability;

FIG. 9 is a tabular list of stability data for the cone dart;

FIG. 11 is a tabular list of stability data for the boat-tail;

FIG. 12 is a tabular list of stability data for witch's-hat designs;

FIGS. 15A-15C are tabular lists of stability data for the cylinder-cone;

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Various exemplary embodiments provide an arrangement for packing and releasing a larger plurality of conical darts than available in conventional designs. The exemplary designs provide a payload of conical shaped darts that fit into the 155 mm HE projectile. The embodiments account for the stress the projectile experienced at firing-launch and in-flight. After ejecting the darts out the rear of the round, the projectile's in-flight stability is maintained to ensure maximum penetration. The embodiments thus satisfy several criteria.

Figure 1:
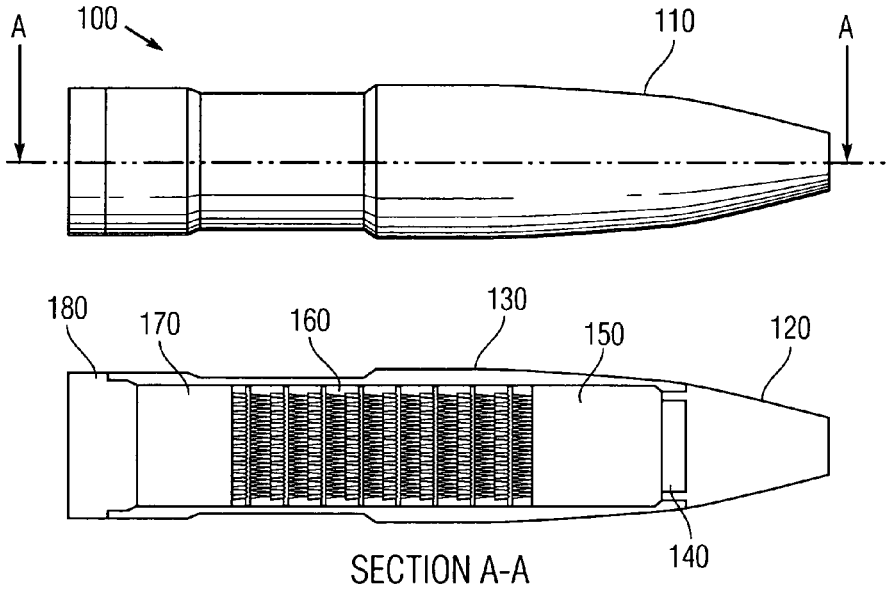
FIG. 1 is an elevation view of a 155-mm cargo round.

FIG. 1 shows elevation views 100, both upper external and lower cross-sectional, of the 155 mm HE projectile round 110. In the A-A cross-section, the round 110 includes a truncated conical nose 120 and a shell casing 130, which forms a cylindrical chamber. An expulsion charge 140 is disposed at the interface between the nose 120 and casing 130. The chamber includes an empty volume 150, a payload region 160 containing a series of cones held by plates, an empty volume 170 and a base plug 180.

The darts contained within the round 110 are designed for stability upon release at a pre-determined time in flight to impact the target nose first. The material for the darts can preferably be tungsten to optimize penetration, but the reactive amalgam aluminum-teflon can also be incorporated into the design of the dart. The payload can be designed for loading a plurality of darts together. This delivery system withstands the initial forces at launch and separates upon expulsion from of the rear of the round 110. The payload separates releasing the plates to shear apart therefore expelling the darts. The darts then strike the target set consisting of light armor vehicles, small boats, personnel, and suspected minefields.

Dart Stability: To design an effective dart, a variety of different shapes were examined between speeds of Mach 1 and Mach 2.5 to evaluate static and dynamic stability. Gyroscopic (or static) stability provides a return to the desired angle-of-attack in response to initial rotation about the yaw axis (perpendicular to the longitudinal axis). This can be quantified by the static stability condition $s_g>1$, as expressed in eqn (1) from http://www.nennstiel-ruprecht.de/bullfly/gyrocond.htm:

$$s_g = \left(\frac{I_x}{I_y}\right)\cdot\left(\frac{\omega\cdot d}{v_w}\right)^2\cdot\left(\frac{1\cdot I_x}{\rho\cdot\pi\cdot d^5\cdot c_{M\alpha}}\right) > 1, \tag{1}$$

where $s_g$ is static stability factor, I is moment of inertia for x along the polar or longitudinal axis (i.e., axial centerline) and y along the vertical transverse or equatorial axis, ω is dart angular (spin) velocity, d is dart diameter, $v_w$ is travel velocity relative to wind, ρ is air density and $c_{M\alpha}$ is overturning moment coefficient derivative for the azimuth angle α. In order to facilitate the dart's ability to approach the target nose first, the design may preferably avoid over-stabilization that can produce an angle-of-attack greater then 10°. The darts are assumed to be axi-symmetric.

Dynamic stability represents another condition for the dart to satisfy in order to be gyroscopically stable. This can be quantified by the condition $0<s_d<2$ as expressed in eqn (2) also from http://www.nennstiel-ruprecht.de/bullfly/dynacond.htm:

$$s_d = \left(\frac{c_{L\alpha} - \frac{m\cdot d^2}{I_x}\cdot c_{Mp\alpha}}{c_{L\alpha} - c_D + \frac{m\cdot d^2}{I_y}\cdot(c_{mq} + c_{m\alpha})}\right), \tag{2}$$

where $s_d$ is dynamic stability factor, m is dart mass, $c_{L\alpha}$ is lift coefficient, $c_{Mp\alpha}$ is magnus moment coefficient derivative, $c_D$ is drag coefficient, $c_{mq}+c_{M\alpha}$ represents pitch damping moment derivative.

In addition, dynamic stability requires static stability to remain below a threshold derived from dynamic stability, as expressed in eqn (3), also from the previous website:

$$s_g > \frac{1}{4\cdot s_d\cdot(1-s_d)}. \tag{3}$$

Figure 2:
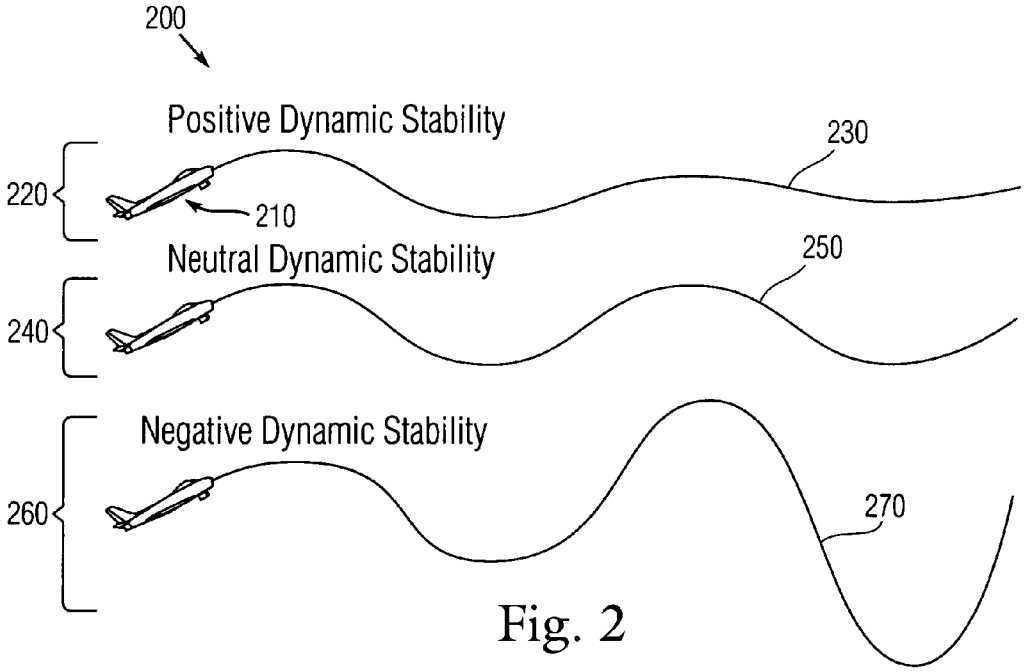
FIG. 2 is an elevation view of oscillation responses.
Figure 6A:
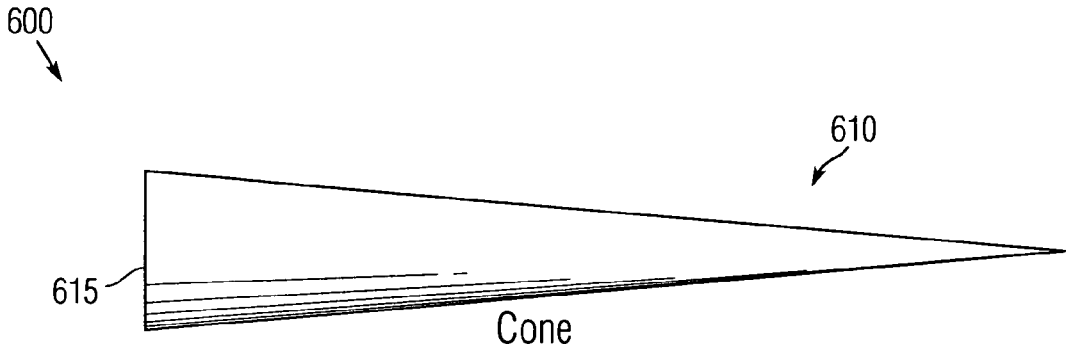
FIGS. 6A-6D are elevation views of proposed dart geometries.
Figure 6B:
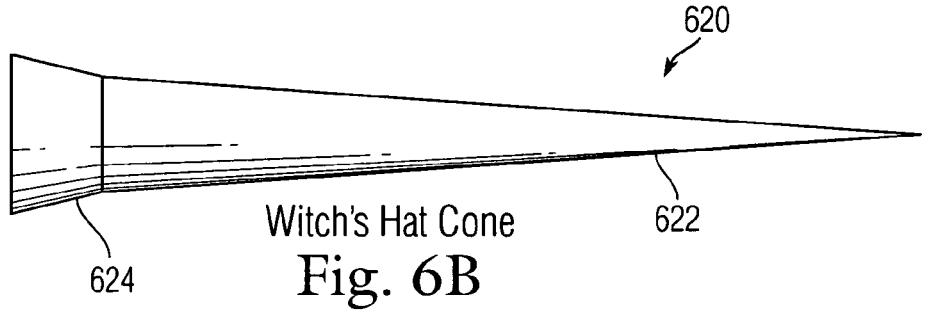
Figure 6C:
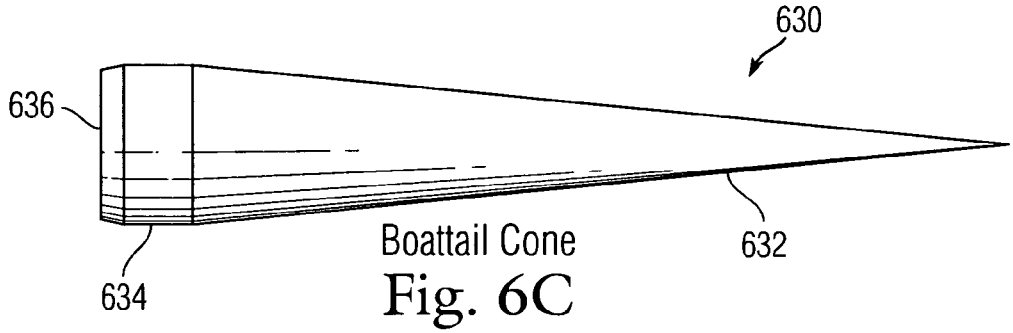
Figure 6D:
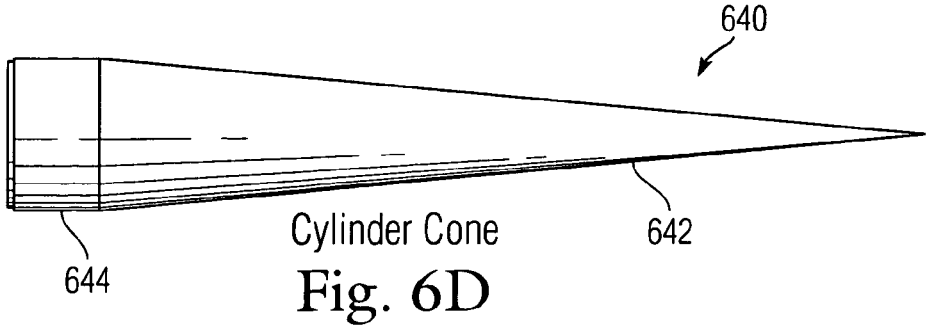

Satisfaction of a dart's dynamic stability of a dart includes dampening of oscillation about the yaw axis, with an eventual return to the initial flight-path. FIG. 2 illustrates example elevation views 200 of an aircraft 210 having pitch oscillations, with the responses including trajectories representing positive, neutral and negative dynamic stability. For the positive stability condition 220 in which $0<s_d<2$, the flight-path 230 shows the oscillations attenuate. For the neutral stability condition 240 in which $s_d=2$, the flight-path 250 shows the oscillations remain sinusoidal at constant amplitude. For the negative stability condition 260 in which $s_d>2$, the flight-path 270 shows the oscillation amplitude increases.

FIG. 3 shows a graph 300 illustrating the parametric region of dynamic stability. The abscissa 310 provides the dynamic stability parameter $s_d$, whereas the ordinate 320 provides the static stability parameter $s_g$. A horizontal line 330 parallel to the abscissa 310 denotes the boundary condition to satisfy static stability. A vertical line 340 together with the ordinate 320 denote the boundary conditions that asymptotically limit dynamic stability parameter $s_d$.

The dynamic stability threshold boundary $s_g=1/s_d\,(2-s_d)$ from eqn (3) is depicted as curve 360 bounded by lines 320, 330 and 340. A shaded region 370 above and inside the curve 360 identifies the region of dynamic stability, such that any point therein is stable in flight. The lower limit for static stability corresponds to $s_g=1$ represented by a line 380, and intersects the curve 360 at the minimum point 390.

Dart Material: The reactive material aluminum-teflon may be preferred in the design of the darts, because its low density (0.2 g/cm$^3$) inert material only detonates at a high-velocity impact. Originally the material begins as powder, but forms into the desired shape under high temperature and pressure, rendering a plastic appearance and texture. Upon striking at a high velocity, the dart shears causing the aluminum and teflon to tear apart, the energy from the separation causes additional damage. One gram of this amalgam shearing at Mach 1 releases about fifteen-hundred calories of energy, equivalent to 25% of a gram of trinitrotoluene (TNT). The carbon reacts with the oxygen to release another thousand calories of energy in a sealed vessel as the penetrated target.

Dart Criteria: Multiple dart designs were considered, all of which required to satisfy several dimensional criteria. Dart designs for the HE round are two inches tall with a diameter of 0.34375 inch. This diameter was selected in order to fit one-hundred-fifty-one darts on a plate that can fit inside the round 110. With this configuration there can be nineteen plates each with one-hundred-fifty-one darts, yielding a total of 2869 darts within the HE round.

Stacked Cones: The dart incorporates an interior conical shape. This permits 1-inch of the dart's upper portion to fit from underneath into the cavity of the dart above. FIG. 4 shows elevation views 400 of a pair of conical darts in tandem configuration. The right side features an exterior view of a lower dart 410 inserted into the bottom cavity of an upper dart 420. The left side illustrates a B-B cross-section with the lower dart 430 having a conical cavity 425 at the bottom, and the upper dart 440. The nose of the lower dart 430 inserts into the corresponding cavity of the upper dart 440.

The internal and external cone half-angles differ slightly from each other to prevent the nose of the lower cone 430 from jamming into the upper cone 440 above. The insertion of lower darts into upper darts reduces volume consumption as well as the dart's weight, and translates the center-of-gravity forward from a solid dart of uniform material. The preferred material is tungsten due to its greater density to enable greater penetrability. However, incorporating reactive materials into the design is also highly desirable due to enhanced effect against the target.

The dart is designed to satisfy static and dynamic stability between Mach 1 and Mach 2.5 flight conditions. To determine the stability characteristics of the dart, a stability and trajectory calculating program called Projectile Data Simulation (PRODAS) was employed. PRODAS is used with small projectiles, like the darts, up to the large artillery shells to calculate mass properties, aerodynamics, aero stability, trajectories, and other properties. The aero stability was the main focus for the darts, which provided the static and dynamic stability. PRODAS uses for input the geometry of the projectile followed by all the initial conditions, such as mass, density, exit muzzle velocity, initial spin rate, caliber of the gun, center of mass, and transverse and axial moments of inertia from the center of mass.

FIG. 5 features Table 1 to provide a list 500 of initial values as inputs into PRODAS for each test dart shape. The program then calculates the aerodynamic properties as data for display in a text document for conversion into Excel. The units are in cgs-metric to provide more precise values under the three-digit input constraint of PRODAS. The diameter, weight, axial, and trans-verse moment of inertia use the mass properties from SolidWorks. Research indicates that maximum muzzle velocity and spin rate are 792.5 m/s and 260 Hz, respectively. The rest of the conditions are provided by the program at standard temperature, pressure (STP), and density.

Dart Geometries: Four different axi-symmetric shapes are considered for the dart round's shape. All concepts maintained the cone shape for the fore-end, but vary at the tail end. FIGS. 6A-6D show elevation external views 600 of four candidate dart configurations. The original concept for the dart was an unmodified cone 610 in FIG. 6A with a length of 2.00 inches and a tail diameter of 0.34375 inch. The other concepts include a witch's-hat cone 620 in FIG. 6B with a fore-cone 622 and an aft-frustum 624, a boat-tail 630 in FIG. 6C with a fore-cone 632 and a short cylindrical mid-section 634 an inverted aft-cone 636, and a cylinder cone 640 in FIG. 6B with a fore-cone 642 and an aft-cylinder 644. The fore-cones 632 and 642 of the respective boat-tail and cylinder cones 630 and 640 are both 1.8 inches in length.

Figure 7:
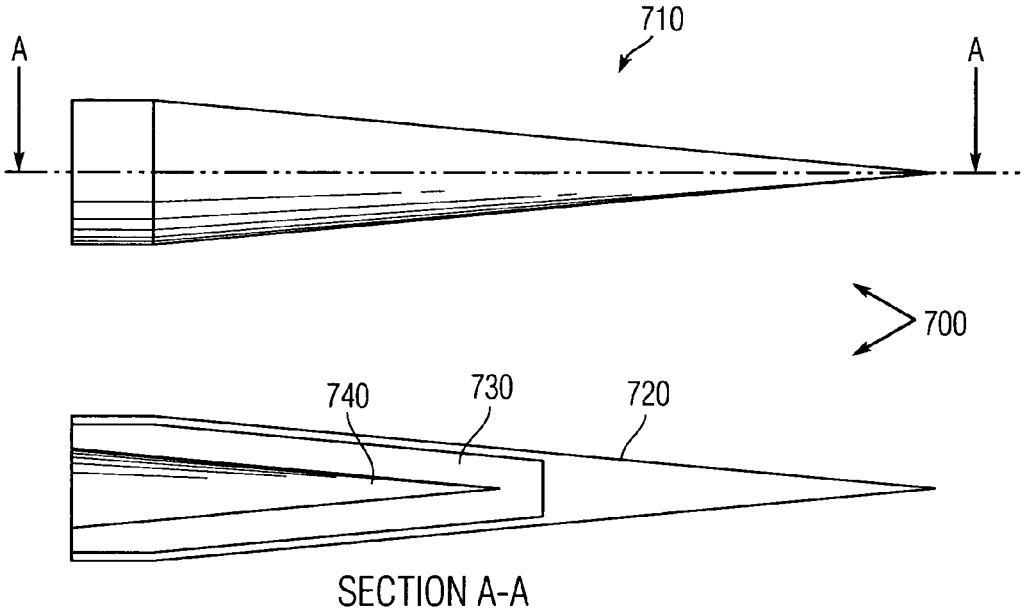
FIG. 7 is an elevation view of a cylinder-cone dart.

FIG. 7 illustrates an exemplary elevation views 700 of the cylinder cone 640 in exterior and A-A cross-section. The cylinder cone dart 710 includes a tungsten nose 720 with an annular shell extending to the rear. Within the cavity formed by the shell is a reactive core plug 730. A conical cavity 740 is disposed within the plug 730 opening rear-ward. The axes of the nose 720, plug 730 and cavity 740 are all co-linear so that the dart 710 is axi-symmetric. Alternatively, the cylinder cone 710 can be monolithic with the same material throughout.

Figure 8:
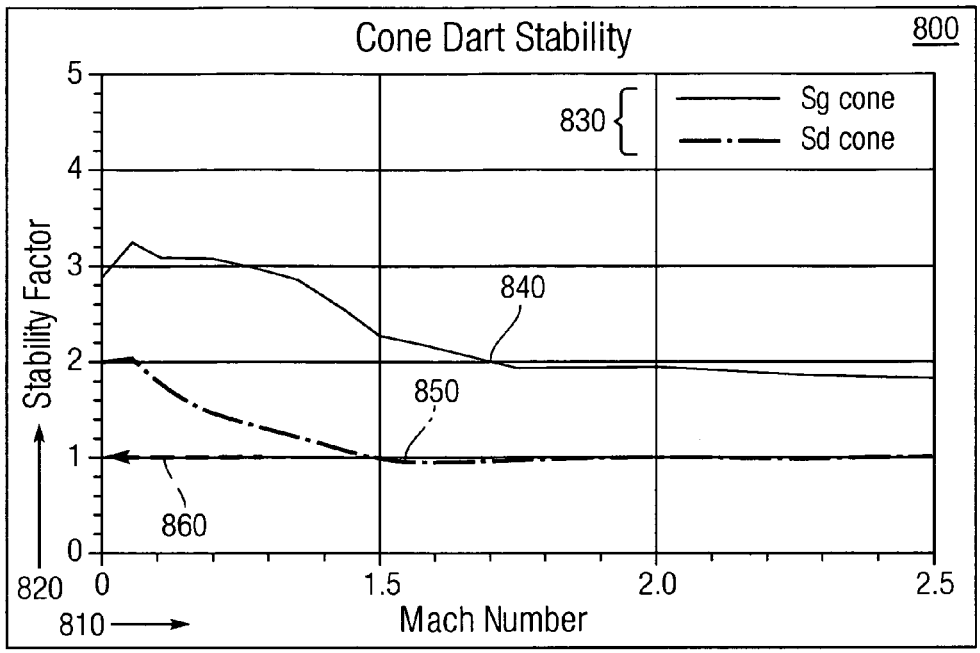
FIG. 8 is a graphical view of cone static stability.

Conical Dart: A cone was selected for the original design because of its stacking ability and ease of manufacturing and mass produce-ability. An aerodynamic simulation of the cone 610 was executed in PRODAS, with the results described herein. FIG. 8 provides a line graph 800 for static and dynamic stability of the cone dart. The abscissa 810 is Mach number and the ordinate 820 is stability factor. The legend 830 represents an upper curve 840 as static stability factor of the cone and a lower curve 850 as dynamic stability factor of the cone. An arrow 860 denotes the static threshold.

FIG. 9 presents Table 2 as a list 900 of parameters across the operable speed range. From Mach 1 to 2.5, the data show the conical projectile to be statically stable, with the highest stability at 3.24 (not considered overly stable). The cone's dynamic stability from Mach 1.1 through Mach 2.5 indicates a return to its original flight path in response to induced oscillation. From Mach 1 through Mach 1.05, the dart remains on its initial path unless disturbed, but without auto-correction.

Figure 10:
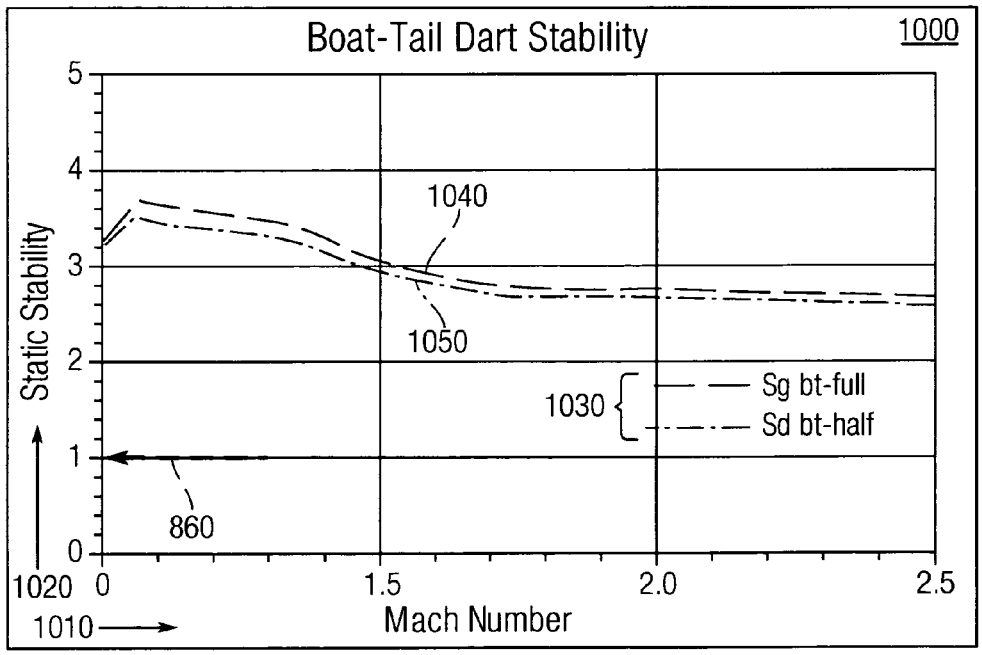
FIG. 10 is a graphical view of boat-tail static stability.

Boat-tail Cone: The boat-tail design is commonly used in projectiles, with a cylindrical offset. An aerodynamic simulation of the boat-tail 630 was executed in PRODAS, with the results described herein. FIG. 10 provides a static stability graph 1000 for the boat-tail. The abscissa 1010 is Mach number and the ordinate 1020 is static stability factor. Two examples of the boat-tail are compared: a first full-boat-tail version that begins the boat-tail a half of the distance from the rear of the cylinder and a second half-boat-tail version that begins the boat-tail a quarter of the distance from the rear of the cylinder. The legend 1030 represents an upper curve 1040 for the full boat-tail and a middle curve 1050 for the half-boat-tail, with the arrow 860 as static threshold.

FIG. 11 presents Table 3 as a pair of lists 1100 across the operable speed range: a first list 1110 of parameters for a full-boat-tail version and a second list 1120 for the half-boat-tail version. The boat-tail (in both versions) is statically stable from Mach 1 to Mach 2.5 and also dynamically stable from Mach 1 to Mach 2.5. This demonstrates that from Mach 1 to Mach 2.5 the dart remains on its flight path and maintains its desired angle-of-attack.

Witch's-Hat: The witch's-hat cone represents a concept intended to reduce dart mass. An aerodynamic simulation of the witch's-hat 620 was executed in PRODAS, with the results described herein. FIG. 12 presents Table 4 as a pair of lists 1200 across the operable speed range: a first list 1210 of parameters for a small-witch's-hat version and a second list 1220 for the large-witch's-hat version.

Figure 13:
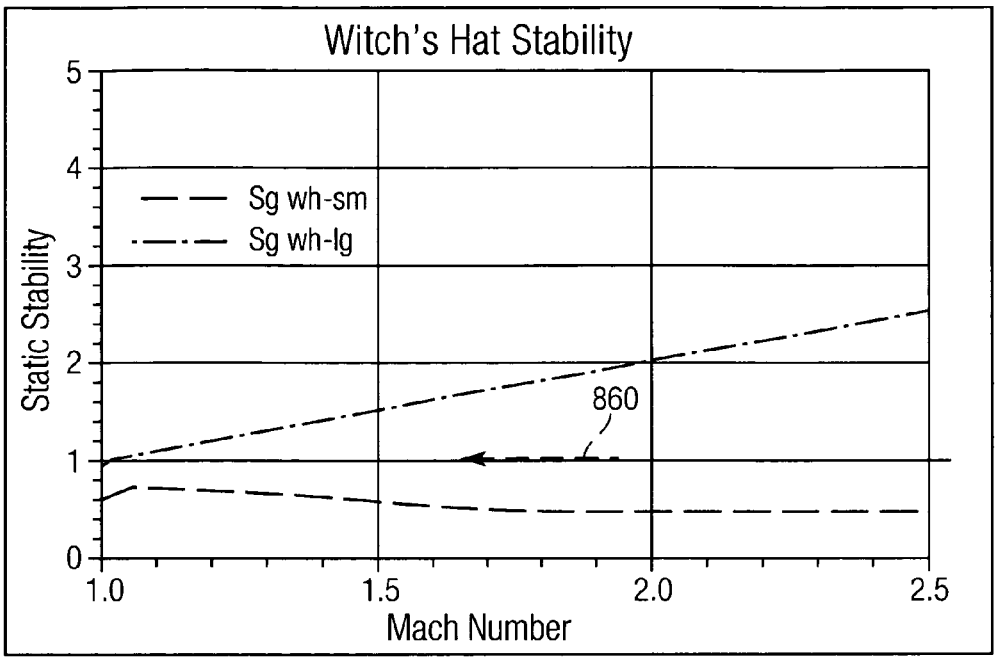
FIG. 13 is a graphical view of witch's-hat static stability.

FIG. 13 provides a static stability graph 1300 for the witch's-hat. The abscissa 1310 is Mach number and the ordinate 1320 is static stability factor. Two examples of the witch's-hat are compared: a first small-witch's-hat version that has a small secondary cone geometry relative to the primary cone's geometry and a second large-witch's-hat version that has a larger secondary cone geometry relative to the primary cone's geometry. The legend 1330 represents an upper curve 1340 for the full boat-tail and a middle curve 1350 for the half-boat-tail, with the arrow 860 denoting static threshold.

The large witch's-hat demonstrates static stable only from Mach 1.05 to Mach 1.35, but becomes unstable above this range. The small witch's-hat is statically unstable throughout the entire Mach range. This means that upon release, an induced rotation about the yaw axis does not dampen out; rather the witch's-hat dart continues to rotate, compromising likelihood of striking the target nose-first, thereby reducing accuracy and kinetic energy transfer. This instability might be due to the center-of-mass being proximate to the center-of-pressure, because without a moment to counteract the acceleration, the witch's-hat dart lacks opposing force for returning to the desired angle-of-attack, and is thus discarded for design considerations in this application.

Figure 14:
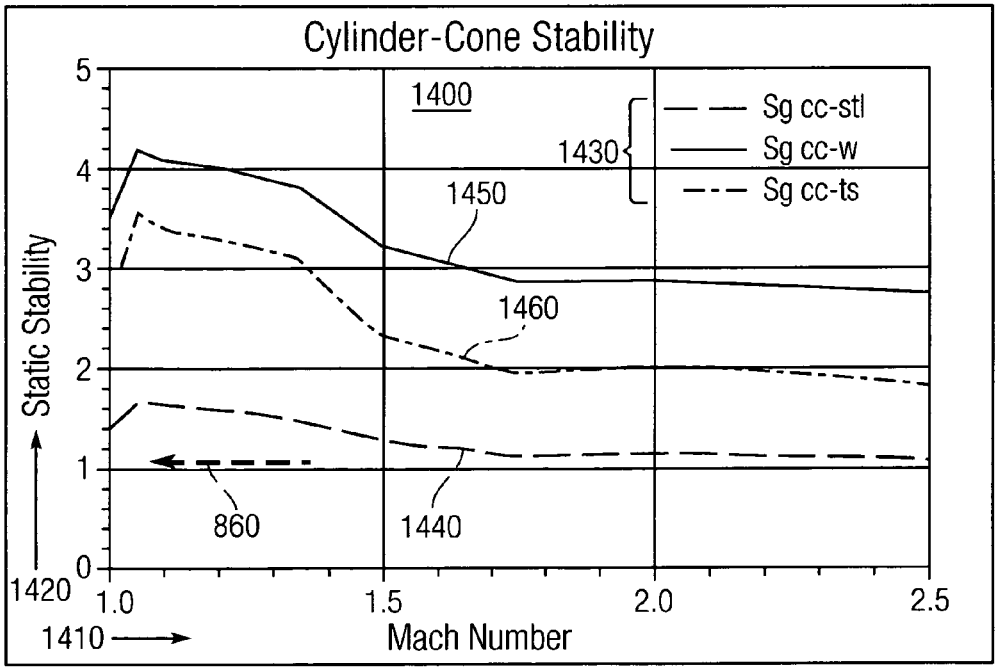
FIG. 14 is a graphical view of cylinder-cone static stability by material comparison.

Cylinder Cone: The cylinder-cone is based off a projectile shape found in some projectiles in military usage. An aerodynamic simulation of the cylinder-cone 640 was executed in PRODAS, with the results described herein. FIG. 14 provides a graph 1400. The abscissa 1410 is Mach number and the ordinate 1420 is static stability factor. A legend 1430 identifies lines corresponding to cylinder-cone variations.

Seven examples of the cylinder-cone are evaluated: a monolithic steel dart with 0.2-inch cylinder, a monolithic tungsten dart with 0.2-inch cylinder, a monolithic reactive dart with 0.2-inch cylinder, a 75%-reactive version of the cylinder, a 25%-reactive version of the cylinder, a tungsten-shell reactive plug, and a reactive cone tip. There are six variations of cylinder cone, three of which are a cylinder cone made out of steel, tungsten, or reactive material. There are also two other variations with 25% and 75% of the 0.2-inch cylinder composed of a reactive material attached to the rest of the cone. A tungsten shell wrapped around reactive material represents another variation, along with a small reactive cone placed inside the tungsten dart.

FIG. 14 shows the difference of static stability between steel and tungsten for the cylinder-cone dart. The abscissa 1410 is Mach number and the ordinate 1420 is static stability factor. A legend 1430 identifies lines corresponding to material variations. Three examples of the cylinder-cone designs are compared from the first, second and sixth versions, respectively: the steel version with curve 1440, the tungsten version with curve 1450, and a reactive version with curve 1460, with the arrow 860 denoting static threshold.

FIGS. 15A through 15C present Table 5 as a series of six lists 1500 across the operable speed range. FIG. 15A includes a first list 1510 of parameters for the steel version, a second list 1520 for the 0.2-inch version, and a third list 1530 for the reactive version. FIG. 15B includes a fourth list 1540 of parameters for the steel version, a fifth list 1550 for the 0.2-inch version, and a sixth list 1560 for the reactive version. FIG. 15C includes a seventh list 1570 of parameters for the steel version, a second list 1520 for the 0.2-inch version, and a third list 1530 for the reactive version. The cylinder-cone (in all versions) is statically stable from Mach 1 to Mach 2.5 and also dynamically stable from Mach 1 to Mach 2.5. This demonstrates that from Mach 1 to Mach 2.5 the cylinder-cone dart remains on its flight path and maintains the desired angle-of-attack.

Design Selection: Analyzing all the types of darts showed that any are a suitable for use except the witch's hat form. The original cone dart develops a large stress at a point upon launch along the bottom of the cones as stacked together. The boat-tail is both statically and dynamically stable, but may be more difficult to manufacture. Thus, the preferred choice is the cylinder-cone due to its distribution of stress along the cylinder. Moreover, the design facilitates manufacture in comparison to alternative designs. Reactive material can be disposed inside of the cylinder cone and the cylinder-cone is both statically and dynamically stable.

Further analysis determined that the mass of a tungsten cylinder cone exceed the carrying weight of the 155-mm cargo round. Currently the cargo round 110 is permitted to weigh only up to 104.8 pounds without fuze; to avoid damage to the gun. With almost three-thousand tungsten darts, the round would weigh up to two-hundred pounds, greatly exceeding that limit. One solution reduces the number of rows from thirteen to six, thereby reducing the carrying capacity to only 906 darts (or only ⅓ of the original) to satisfy the weight requirement. Consequently, the material of the dart was changed to alloy steel.

Alloy steel has about half the density of tungsten, therefore possess about half the mass for the same volume. This allows for 1963 darts out of the 2869 darts maximum to fit into the round 110 and also satisfy the weight limit. The alloy steel is not as statically stable as the tungsten dart, but both are dynamically stable from Mach 1 through Mach 2.5. The ability for the steel dart to pierce light armor and boats is expected to be less than that of tungsten, due to its lower density by comparison. FIG. 7 shows a reactive plug inside of a tungsten shell, with a mass about the same of the steel dart, but expected to possess the penetrability of the tungsten dart. With the dart design chosen, an effective release system can be constructed.

Release System: The release system includes at least one plate that can hold one-hundred-fifty-one darts. These can be stacked thirteen plates high in order to stay within the weight restraint of 104.8 pounds. These holding plates not only secure the darts, but also are able to withstand the shock of launch. Upon ejection from the round 110 into the air stream, they immediately disintegrate, dispersing the darts without restraint. An expulsion cylinder holds the thirteen plates to withstand the shock of launch. The cylinder is sufficiently strong to shear the threads on the outer circumference of the cargo round base plug 180. The threads connect the base plug 180 to the casing 130 and separate upon release into the air.

Figure 16A:
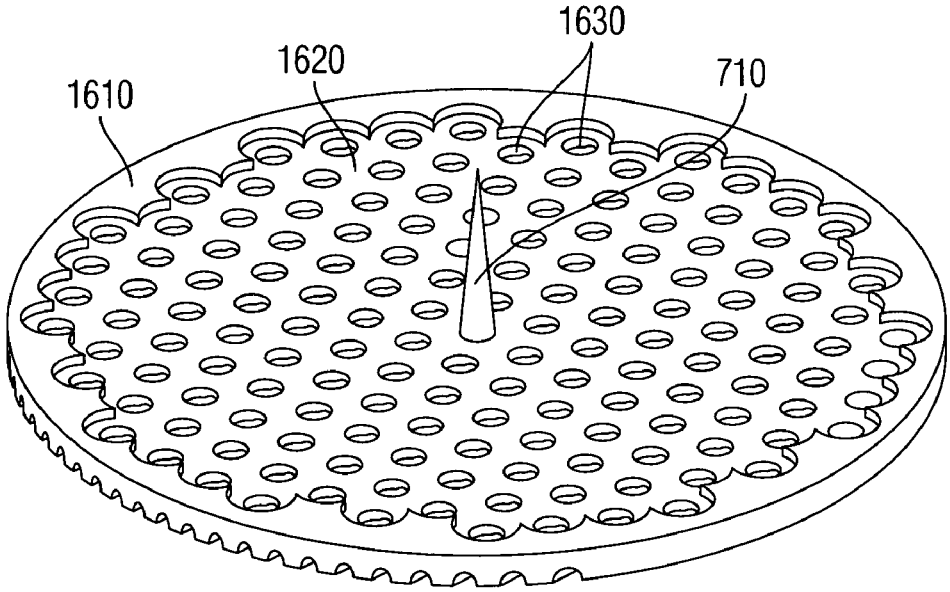
FIGS. 16A and 16B are isometric views of a carrying plate.
Figure 16B:
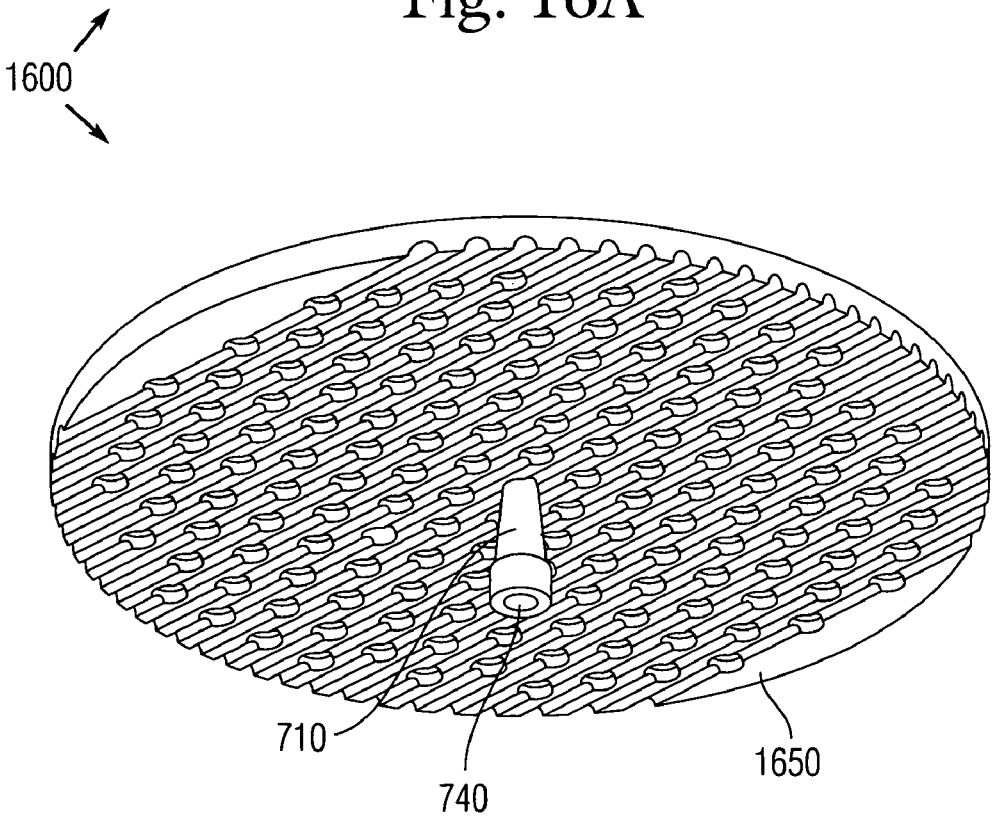
Figure 16C:
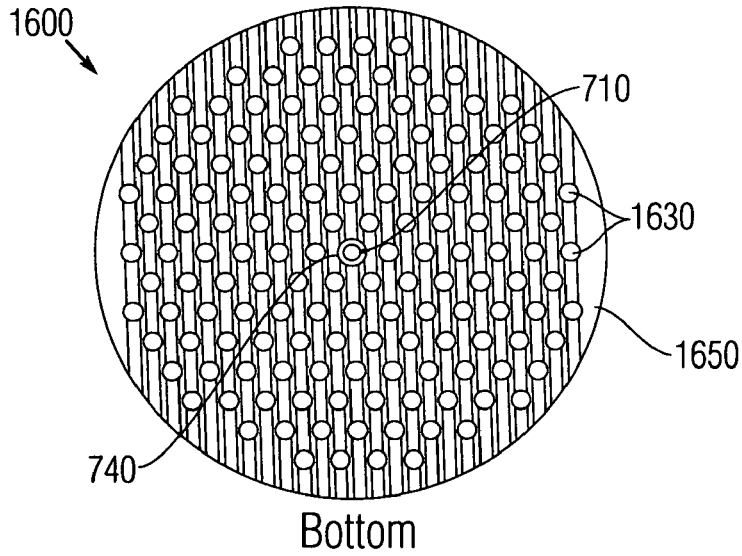
FIGS. 16C through 16E are plan and elevation views of the plate.
Figure 16D:
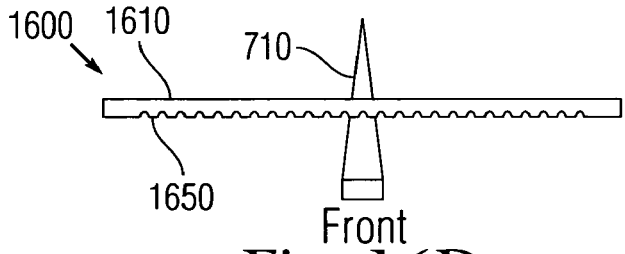
Figure 16E:
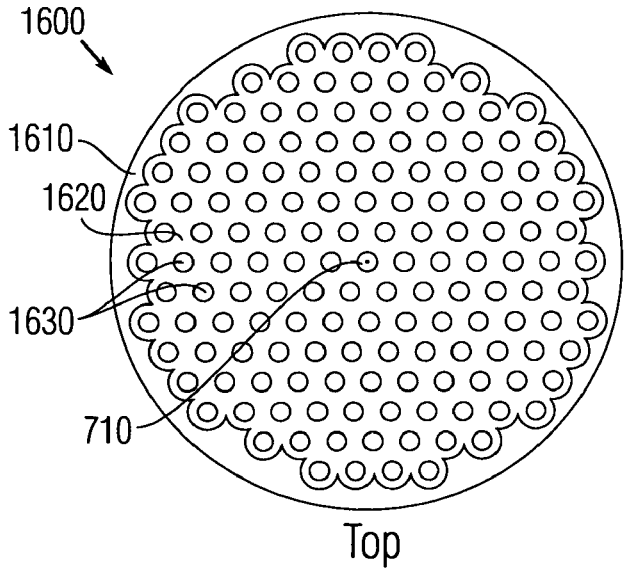

Design of Holding Plates: FIGS. 16A-16E show views of a holding plate 1600, having a 0.2-inch thickness and composed of Aluminum Al-3003. FIGS. 16A and 16B show isometric views from above and below respectively, FIG. 16C shows a plan view from the reverse (bottom) side, FIG. 16D shows an elevation view showing thickness, and FIG. 16E shows a plan view from the obverse (top) side. Of the thickness, 0.1-inch provides a lip along the plate's top surface 1610 meant to firmly hold the top row of darts in place and the remainder 0.1-inch represents a bounded recessed region 1620 with holes 1630 to hold a lower row of darts firmly in place, of which a single example dart 710 is shown. The plate's reverse surface 1650 may include corrugation row divots or scores of 0.085-inch to facilitate fragmentation upon release from the round 110. The cavity 740 provided at the rear of the cylindrical cone dart 710 provides a receptacle for the nose of a lower dart to be inserted.

The plate 1600 is designed with one-hundred-fifty-one holes 1630 in a hexagonal pattern, although other regular patterns can be contemplated. Each hole 1630 holds a corresponding dart 710 to enable the top one-inch of the dart to protrude from the top surface 1610 for insertion into the cavity 740 of the dart above on an adjacent plate 1600. This arrangement enables adjacent tandem plates 1600 to be stacked above each other, together with their corresponding darts 710. The top one-inch of the nose of the lower dart 410 inserts into the rear cavity 740. Each plate 1600 can hold up to approximately three pounds of mass and withstand a centripetal force of 260 Hz and 10,000 G's of acceleration. After release from the expulsion cylinder 1830 the plates 1600 are sufficiently fragile to frangibly break apart immediately so that the darts 710 can disperse un-restrained.

Plate In-Flight Stress Analysis: Cosmos software is a stress analysis program in SolidWorks® used to calculate the stresses on the plate 1600, suspended as a free-floating object with no forces applied thereto. A centripetal force of 260 Hz was then applied to simulate spinning in-flight. Lift and drag viscous forces from the air contacting the plate were not incorporated into the simulations, in order to determine whether the plate breaks merely from centripetal force as intended.

Figure 17A:
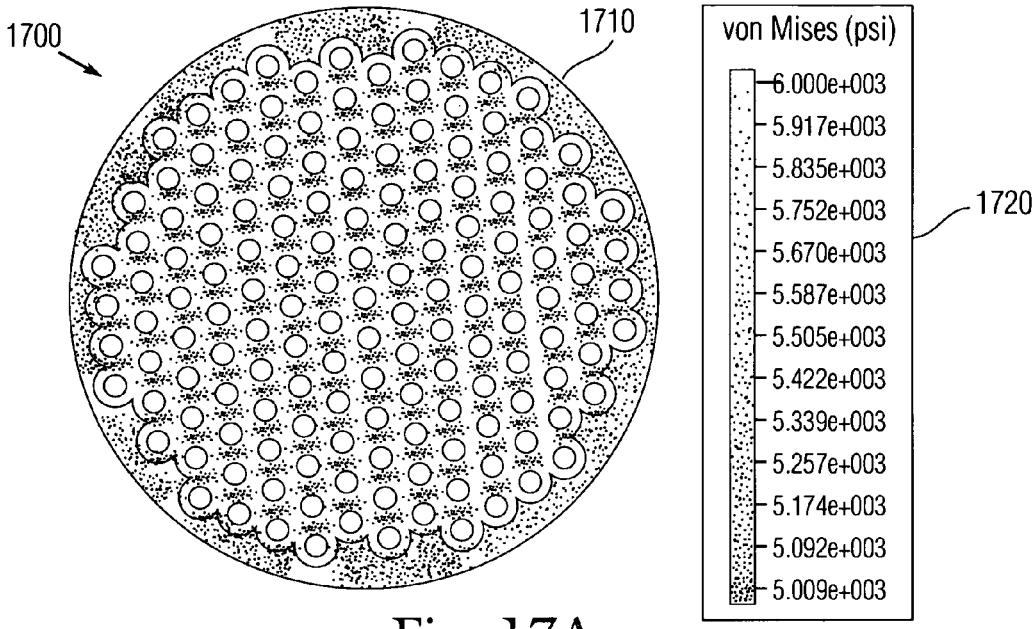
FIGS. 17A and 17B are plan view contour plots of the plate.
Figure 17B:
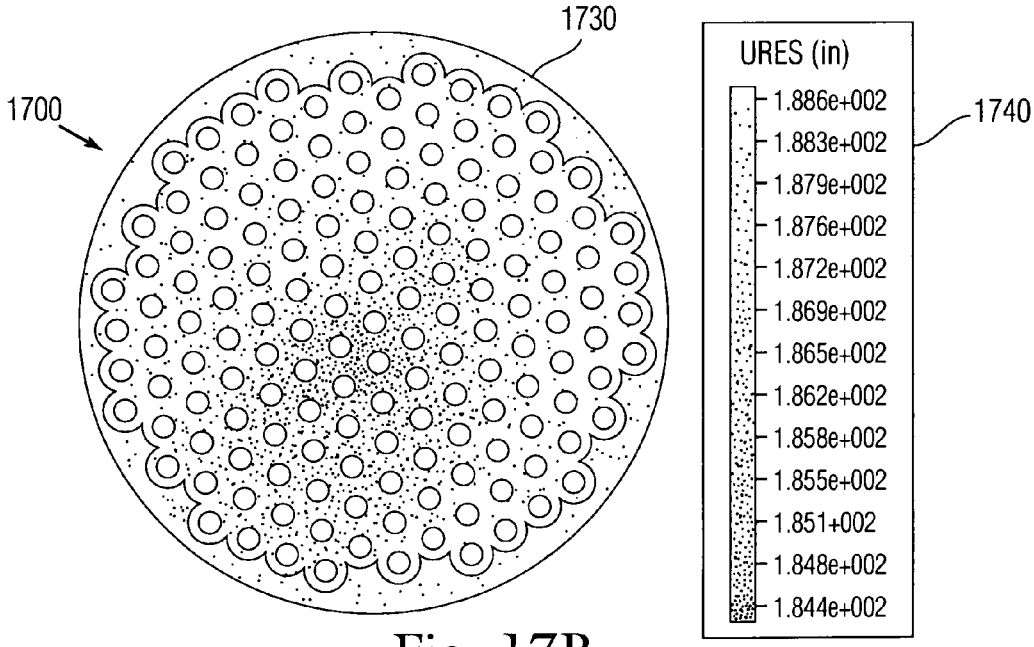

FIGS. 17A and 17B present contour plots 1800. FIG. 17A illustrates von Mises stresses 1710 adjacent to a stress legend 1720 (in psi). The plots 1700 indicate that the plate 1600 shears along the scores on the plate's reverse side 1650, thereby releasing the darts 710. The response analysis in FIG. 17B presents displacement responses 1730 adjacent to a strain legend 1740. These analyses indicate that the plate tears apart, based on the relatively high displacement values solely due to centripetal force.

Figure 18:
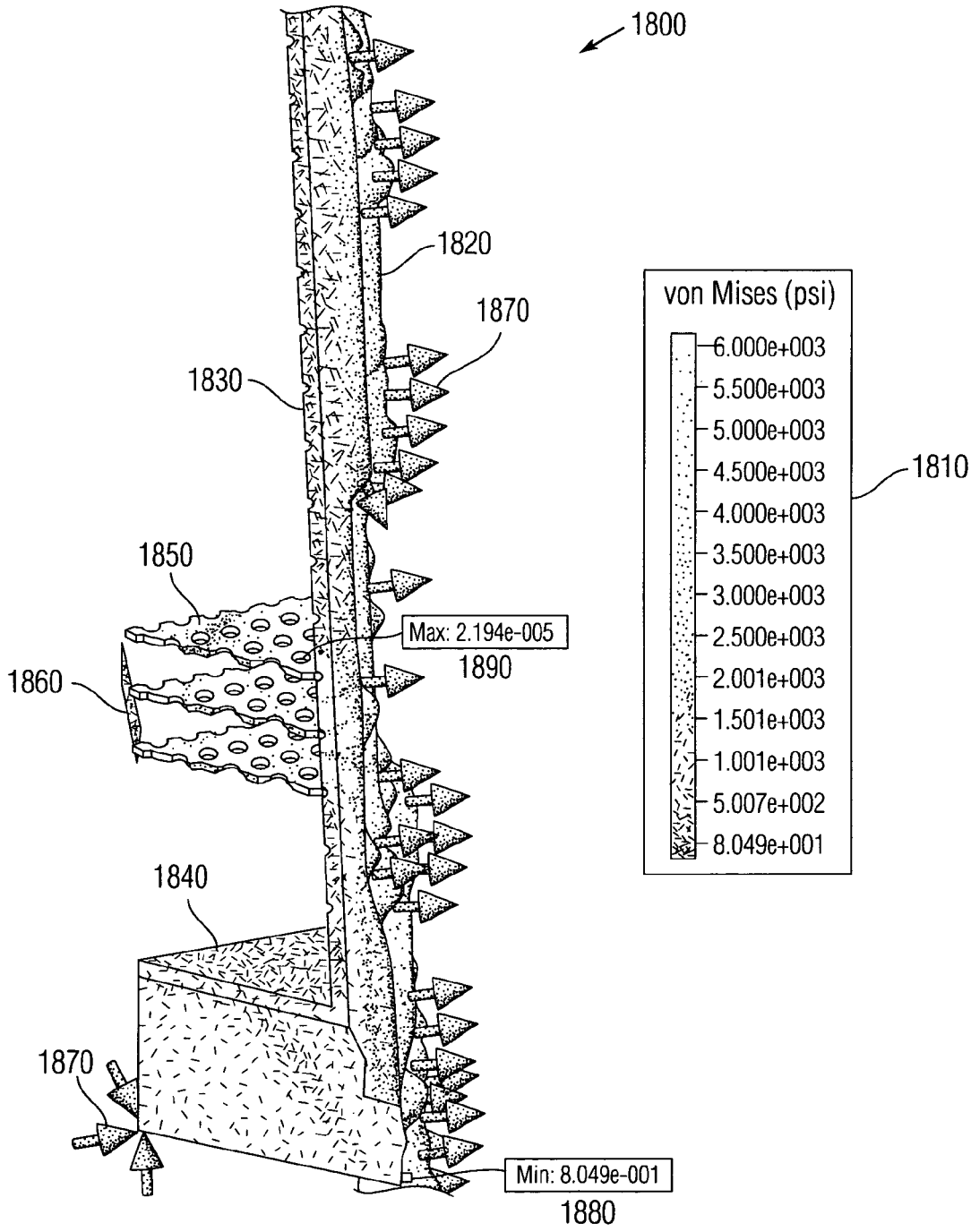
FIG. 18 is an isometric view of an axi-symmetric wedge-model contour plot the round.

Plates Launch Stress Analysis: For the stress analysis on aluminum Al-3003 plates, Cosmos revealed that the centripetal force induced by an angular rate of 260 Hz and 10,000 G's of acceleration shears the plate 1700. FIG. 18 illustrates this Al-3003 result by a contour plot 1800 of an axi-symmetric wedge of the round 110 adjacent to a legend 1810. The yield strength of aluminum Al-3003 is 6000 psi, represented by the upper value in the legend 1810. The round 110 includes an exterior 1820 (representing the casing 130), a notched interior 1830, and an aft closure 1840 (representing the tail 180). The interior 1830 holds an exemplary triple series of plates 1850, one of which holds a dart 1860. Centripetal force vectors are shown 1870 along corresponding surfaces.

Figure 19:
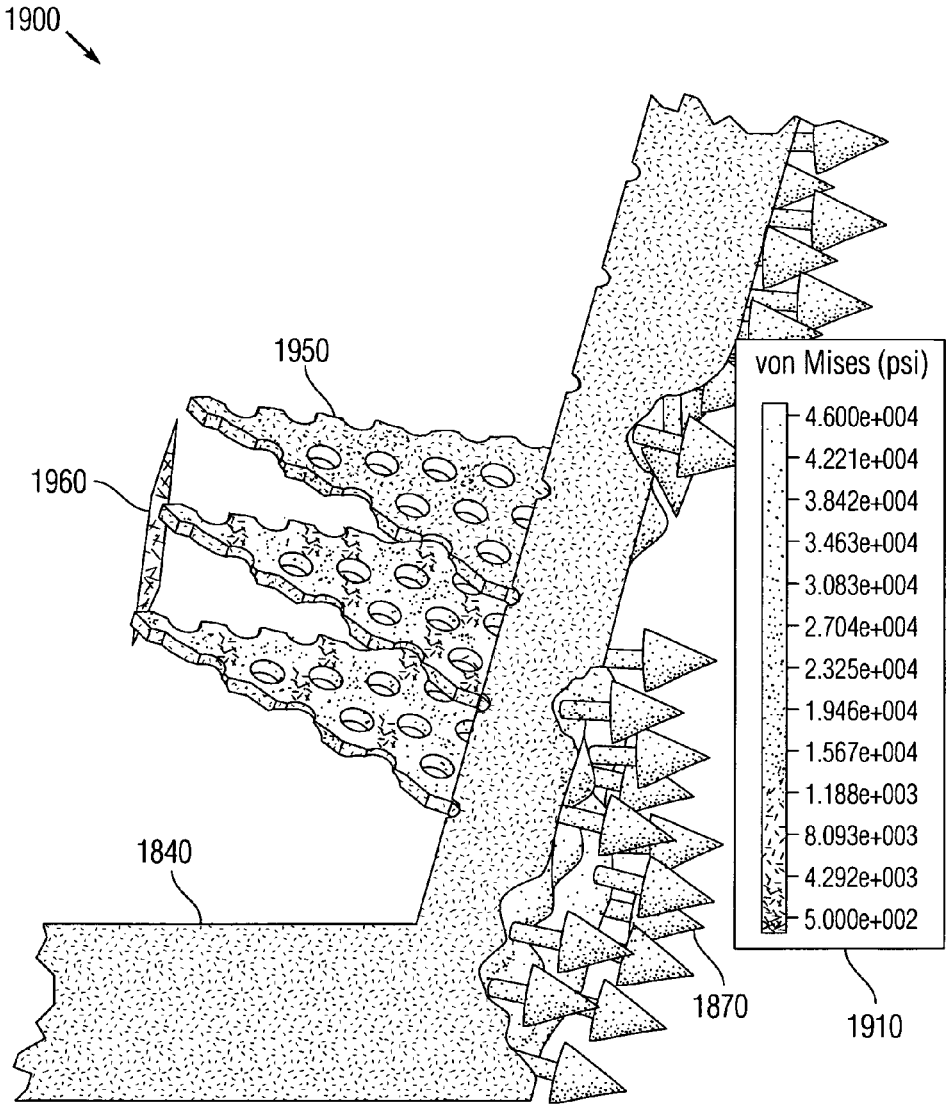
FIG. 19 is a detail isometric view of the wedge-model contour plot.

The plates 1850 exceed 6000 psi at most their surfaces. The material of the plate was then changed to aluminum Al-2018 that has a higher yield strength of 46,000 psi. Another stress analysis executed under the same conditions. FIG. 19 shows this Al-2018 result by a contour plot 1900 adjacent to a legend 1910. These results showed that the plates 1950 withstand the forces 1870 of launch. The Al-2018 plate was then analyzed by itself in mid-air and the stress analysis showed that the plates 1950 do not shear with 260 Hz of centripetal force. Thus, the plate material preferably remains Aluminum Al-3003, with bands or columns can be disposed underneath the plates for additional reinforcement. Alternatively, deeper scoring on the obverse side 1650 may weaken the plate structure of Al-2018 for adequate frangibility.

The dart chosen, reactive plug with tungsten tip, offers the best flight stability as well as potential lethality. Upon piercing an object with the tungsten tip, the dart fractures the reactive material, thereby causing an explosion with a magnitude of 25% of a gram of TNT. With almost 2000 darts and the release system, the cargo round maintains under the maximum requirement for weight. The stress analysis shows that unreinforced plates cannot withstand the conditions at launch, but do break apart upon ejection from the round 110. Overall, this round can be used to penetrate boats, light armor vehicles, personal and mine-fields, and to generate secondary damage from the reactive material.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A cargo round for dispensing submunitions, said round comprising:

a nose tip;

a casing attached to said tip, said casing forming a chamber;

a tail; and a payload disposed within said chamber between said tip and said tail, said payload including:

a plurality of axi-symmetric darts, each dart having fore and aft ends along a polar axis, with a cone at said fore end and a conical cavity at said aft end, and front and rear tandem plates, each plate having a plurality of orifices arranged in a symmetric pattern, each said orifice of the front plate receiving a corresponding one of said darts such that said corresponding dart protrudes from both obverse and reverse sides of said front plate, each said orifice of the rear plate receiving one of said darts such that said one of said darts protrudes from both obverse and reverse sides of said rear plate, wherein each said fore end of each dart in said rear plate is inserted within said cavity of a dart in said front plate, and each said plate shears apart on release of said payload from said cargo round to disperse said darts.

2. The cargo round according to claim 1, wherein said each dart has a cylinder at said aft end.

3. The cargo round according to claim 1, wherein said each plate has a plurality of notches arranged in rows on one of said obverse and reverse sides.

4. The cargo round according to claim 3, wherein said each plate has a lip at an outer rim and bounded recess region within said lip, said region and lip being on another of said obverse and reverse sides, wherein said orifices are disposed in said region.

5. The cargo round according to claim 1, wherein said plurality of orifices are arranged in an hexagonal pattern.

6. A payload for a cargo round for dispensing submunitions and disposed within a chamber thereof, said payload comprising:

a plurality of axi-symmetric darts, each dart having fore and aft ends along a polar axis, with a cone at said fore end and a conical cavity at said aft end; and front and rear tandem plates, each plate having a plurality of orifices arranged in a symmetric pattern, each said orifice of the front plate receiving a corresponding one of said darts such that said corresponding dart protrudes from both obverse and reverse sides of said front plate, each said orifice of the rear plate receiving one of said darts such that said one of said darts protrudes from both obverse and reverse sides of said rear plate, wherein each said fore end of each dart in said rear plate is inserted within said cavity of a dart in said front plate, and each said plate shears apart on release of said payload from said cargo round to disperse said darts.

7. The cargo round according to claim 6, wherein said each dart has a cylinder at said aft end.

8. The cargo round according to claim 6, wherein said each plate has a plurality of notches arranged in rows on one of said obverse and reverse sides.

9. The cargo round according to claim 8, wherein said each plate has a lip at an outer rim and bounded recess region within said lip, said region and lip being on another of said obverse and reverse sides, wherein said orifices are disposed in said region.

10. The cargo round according to claim 6, wherein said plurality of orifices are arranged in an hexagonal pattern.

* * * * *